US005700527A

United States Patent [19]

Fuchs et al.

[11] Patent Number: 5,700,527

[45] Date of Patent: Dec. 23, 1997

[54] SOUND-ABSORBING GLASS BUILDING COMPONENT OR TRANSPARENT SYNTHETIC GLASS BUILDING COMPONENT

[75] Inventors: Helmut Fuchs, Schönbuch, Germany; Xuegin Zha, Böblingen, China

[73] Assignee: Fraunhofer-Gesellschaft Zur Foerderung der Angewandten Forschung e.v., Munich, Germany

[21] Appl. No.: 545,845

[22] PCT Filed: May 10, 1994

[86] PCT No.: PCT/EP94/01511

§ 371 Date: Nov. 13, 1995

§ 102(e) Date: Nov. 13, 1995

[87] PCT Pub. No.: WO94/26995

PCT Pub. Date: Nov. 24, 1994

[30] Foreign Application Priority Data

Nov. 5, 1993 [DE] Germany ..... 43 15 759.9

[51] Int. Cl.[6] ..... G10K 11/16

[52] U.S. Cl. ..... 428/34.4; 52/144; 181/224; 181/286

[58] Field of Search ..... 428/34.4; 52/144; 181/224, 286

[56] References Cited

U.S. PATENT DOCUMENTS 4,787,473 11/1988 Fuchs et al. ..... 181/21.4

FOREIGN PATENT DOCUMENTS

| | | |
|---|---|---|
| 0 378 979 | 7/1990 | European Pat. Off. . |
| 0378979 | 7/1990 | European Pat. Off. . |
| 27 58 011 C2 | 6/1979 | Germany . |
| 91 16 233 | 7/1992 | Germany . |
| 43 12 886 | 8/1994 | Germany . |
| 43 12 885 A1 | 10/1994 | Germany . |

OTHER PUBLICATIONS

Fuchs, H.V.: XUR Absorption tieter frequenzen in Tonstudios Rundfunklechnisches Mittcilungen rtm 36 (1992), H. 1, pp. 1–11.

Maa, D.Y.: Theory and design of microperforated panel sound absorbing constructions. Scientia Sinica 18 (1975), II. 1, (in Chinese).

*Primary Examiner*—Charles Nold

*Attorney, Agent, or Firm*—Evenson, McKeown, Edwards & Lenahan P.L.L.C.

[57] ABSTRACT

A sound absorbing glass building component or transparent synthetic glass building component is provided with holes penetrating through it and is disposed at a distance from a surface, such as a wall, ceiling, window or door. The glass building component is formed as a panel having microperforated holes having a diameter of 0.1–2.0 mm, the holes being spaced 2–20 mm apart and the panel having a thickness of 0.2–30 mm.

20 Claims, 7 Drawing Sheets plane
plane-parallel
slanted
layered curved
concave
convex
structured edged
protruding
indented
stretched plane
plane-parallel
slanted
layered curved
concave
convex
structured edged
protruding
indented
stretched

| | t | d | b | D | p % |
|---|---|---|---|---|---|
| Type 1 | 5,00 | 0,50 | 2,50 | 25 | 3,14 |
| Type 2 | 5,00 | 0,65 | 4,00 | 50 | 2,07 |
| Type 3 | 5,00 | 0,80 | 6,00 | 100 | 1,40 |

| | t | d | b | D | p % |
|---|---|---|---|---|---|
| Type 1 | 5,00 | 0,50 | 2,50 | 25 | 3,14 |
| Type 2 | 5,00 | 0,65 | 4,00 | 50 | 2,07 |
| Type 3 | 5,00 | 0,80 | 6,00 | 100 | 1,40 |

SOUND-ABSORBING GLASS BUILDING COMPONENT OR TRANSPARENT SYNTHETIC GLASS BUILDING COMPONENT

BACKGROUND AND SUMMARY OF THE INVENTION

The present invention relates to a sound-absorbing building component made of glass or transparent synthetic glass and having holes penetrating through the building component, which is disposed at a distance from a surface. A component as generally described above is known from German Patent Document DE-G 91 16 233.6U1.

Conventional sound absorbers, also known as passive absorbers, employ porous or fibrous material in order to convert airborne sound vibrations into heat by means of friction on their finely structured, as open as possible surface structure.

Thus, the macroperforated (i.e., having a hole-surface portion of 5–30%) glass pane facing the sound field described in German Patent Document DE G 91 16 233.6 as a transparent cover with a multiplicity of perforations each having surface dimensions ranging from 20 $mm^2$ to 20 $cm^2$ lets sound pass almost unimpeded to sound absorbing elements disposed in the air space between the glass panes. Accordingly, only the sound energy that passed through the holes in the air space can be absorbed there by the sound absorbing elements.

Alternatively, energy in a relatively wide frequency band is withdrawn from the soundwaves occurring in so-called reactive absorbers by means of the resonation of foils, panels or membranes if the resonance is dampened by porous, fibrous or viscose dampening layers. Reactive sound absorbers are also known that require no additional dampening material. They are however either designed with multiple layers of foils, panels or membranes, or/and provided with relatively large, beveled holes, or/and provided with a markedly structured (e.g., relief-like) surface, so that a multiplicity of panel and air vibrations are excited.

Recently consultant and development projects have seen an increase in the demand for sound absorbers made of structurally stable and chemically highly resistant ceramic materials. In both technical and structural acoustics, there is a need for sound absorbers that can function without porous or even fibrous dampening materials.

The portion of glass building components in the surfaces of the exteriors and interiors of office and public buildings has increased greatly. As glass, especially when very thick, practically totally reflects soundwaves in a wide frequency range, acoustical problems frequently arose regarding reverberation time and acoustic-impairing ricocheting. Particularly critical in this respect are rooms with concave surfaces, which can cause sound to converge.

All the previously known absorbers can be made to a certain degree translucent by selecting suitable vibration dampening materials. Up to now however, it has not been possible to utilize completely transparent glass or plastic building components with a completely smooth, hard, non-vibratable closed surface for sound absorption. Indeed, glass surfaces for enclosing space are considered to be acoustically completely hard (totally reflecting). The continuing trend toward more and larger glass walls and ceilings, which moreover are often concave in shape, can lead to especially acoustic-impairing sound concentrations occurring toward the center of the curvature. This decisive drawback of glass building components is becoming increasingly apparent. In objects that also have to meet certain acoustical requirements in addition to structural, optical and lighting specifications, the architect has previously been forced to make major concessions in his concept. Such an architect was compelled to, at least partially, either replace the glass building components with sound absorbing non-transparent building components, or neutralize the glass building components by placing additional non-transparent sound absorbers near them, or by placing near the glass building components additional reflectors (also transparent) which deflect or scatter the ricocheting soundwaves in such a manner that they no longer disturb the "acoustics" of a room.

An object of the present invention is to create a glass building component that is sound absorbing and remains transparent. This object has been achieved according to the present invention by providing a sound absorbing building component made of glass or synthetic glass and having holes penetrating through the building component, which is disposed at a distance from surface, wherein the glass building component comprises a panel having microperforated holes having a diameter of 0.1–2.0 millimeters, the holes being spaced 2–20 millimeters apart, and the panel having a thickness of 0.2–30 millimeters.

The new sound absorber itself is composed solely of one or multiple completely light-transparent panels which airborne soundwaves can hardly excite. Numerous very small holes penetrating through the surface of the absorber facing the room in conjunction with a hollow space disposed behind the absorber (similar to the micro-perforated panels in front of an acoustically hard wall described in Maa, D.-Y.: "Theory and design of microperforated panel sound absorbing constructions." *Scientia Sinica* 18 (1975), H. 1, pp. 55–71) enable the absorber to absorb soundwaves in a wide frequency band of the audible range. The holes may be made with borers, lasers, or plasma welding.

In order to be able to solve the problems described above, sound absorbers have been provided which can be mounted retroactively plane-parallel as close as possible to the reflecting glass building components and which do not detract from the architect's concept. In rooms intended for predominantly audio purposes, these plane, transparent absorbers, in particular if the soundwaves in the frequency range between f=125 to 1250 Hz strike perpendicular, have an absorption of more than 50%, at 500 Hz close to 100%.

In many respects, several high-resistent plastics as well as glass, but indoors also acrylic glass (clear or tinted) have proven to be the ideal material for such sound absorbers. If panels of this material with a thickness ranging between t=2 to 12 mm are mounted at a distance of between D=25 to 100 mm in front of the glass building component, amazingly wide banded sound absorbers can be developed as comprehensive testing has shown. They do not require porous or fibrous materials but rather only relatively small holes with diameters d=0.1–3 mm, preferably however 0.1–0.8 mm. In multilayer assembly, resonance absorbers can be designed according to German patent application DE P 43 12 886, which absorb more than 80% of the entire significant frequency range on one and the same absorber surface.

The principle of micro-perforated transparent sound absorbers can be advantageously realized with three structural variants, including separate absorber front panels, absorber integration into building components, and separate building or decorative components.

DETAILED DESCRIPTION OF THE DRAWINGS

Figures 1A, 1B, 1C:
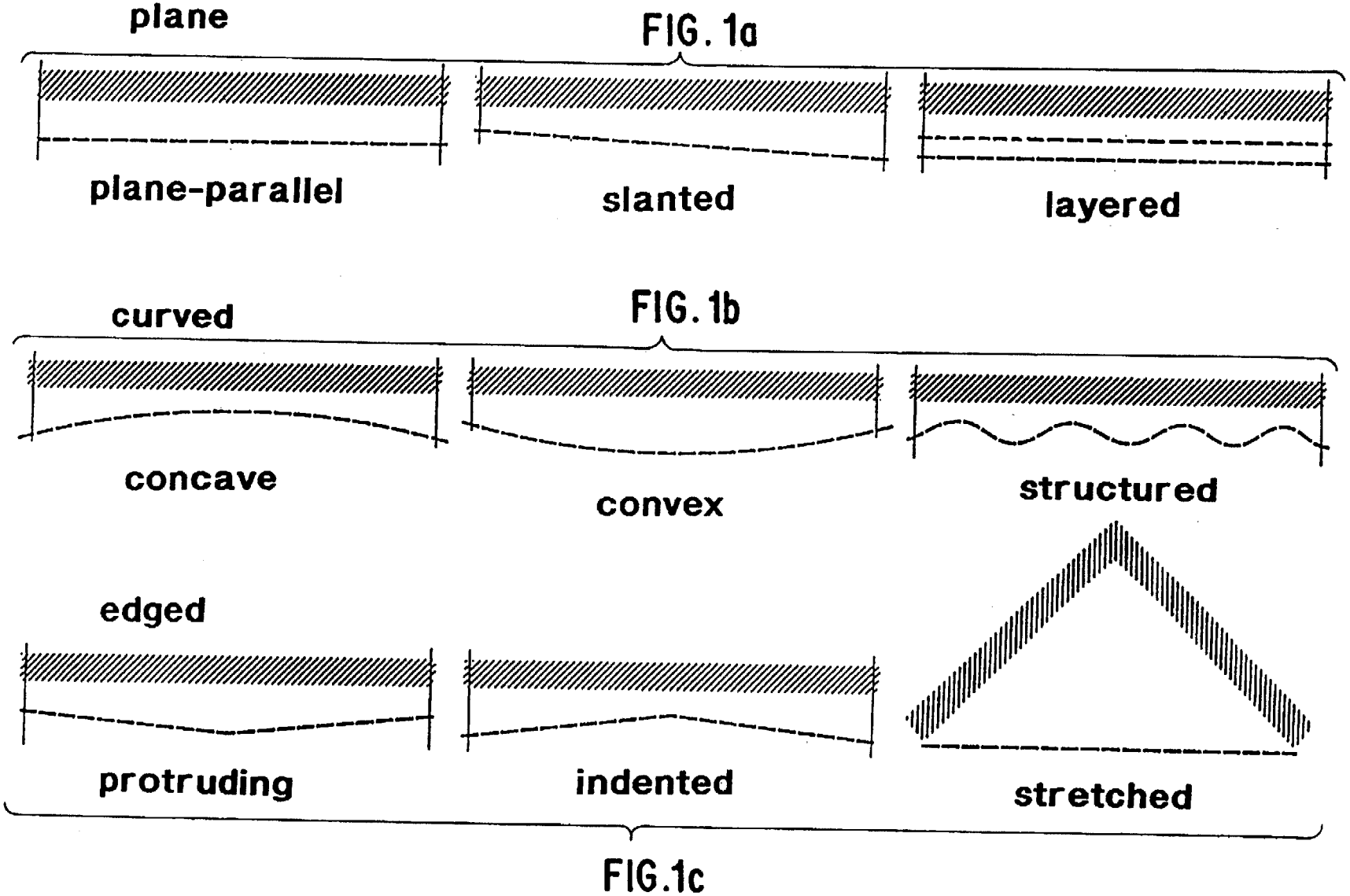
FIG. 1 shows the sound absorbers according to the present invention in the form of front panels having various configurations.

If the absorbers shown in broken lines in FIG. 1 are retroactively inserted in front of the actual glass components shown in shaded lines, their structural, illuminating and optical functions are retained practically fully intact. For example, the holes (e.g., having diameters d between 0.2 to 2 mm and distance b between the holes between 2 to 10 mm ) can be disposed in the front panels so small and regularly that transparency is hardly impaired.

The front panels are mounted at a distance of D=20–500 mm in front of the building component (window, wall, door). The space between the front panel and the glass building component may be closed as indicated in FIG. 1. The front panel may however also be suspended without lateral boundaries. Absorption occurs as long as the distance is small compared to the length and width of the front panels.

The front panel may be disposed as FIG. 1 shows, plane, slanted or in layers and designed curved, convex or structured, e.g., wavy, knobbed zig-zag, pyramid-shaped, etc. As shown in FIG. 1.3, the front panels may be edged or disposed stretched across a corner.

The absorbers may be integrated into separate building components, e.g., in walls, ceilings and false ceilings or also mounted, suspended or placed in front of already present building components. In this way, they not only permit absorption that can be adjusted to the respective requirements but in addition also scatter soundwaves in concerted reflexes into regions of the room where they do no harm or are absorbed. The absorbers may take the form of coffers, or chambers. In this variant according to FIG. 2, the absorber can also assume structural functions, like a kind of glass building block simultaneously having high sound dampening properties. The absorbers may also be used in false ceiling systems such as those disclosed in German Patent Application DE 43 12 885, in partition walls, and as sound dampening and soundproofing building components for cladding, cabins and canals.

Figures 2A, 2B, 2C:
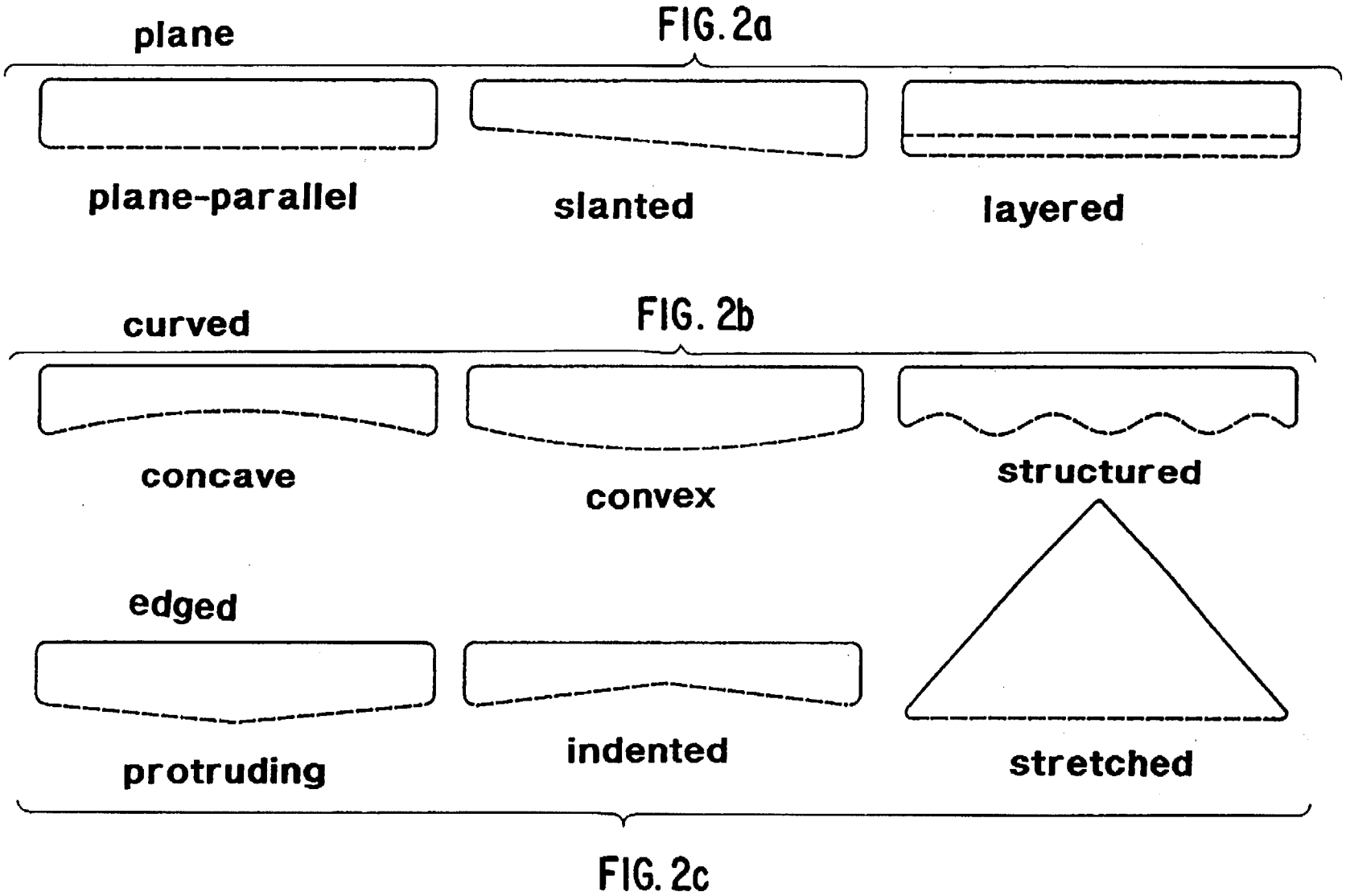
FIG. 2 shows the sound absorbers according to the present invention integrated into building components to form chambers having various configurations.
Figure 3:
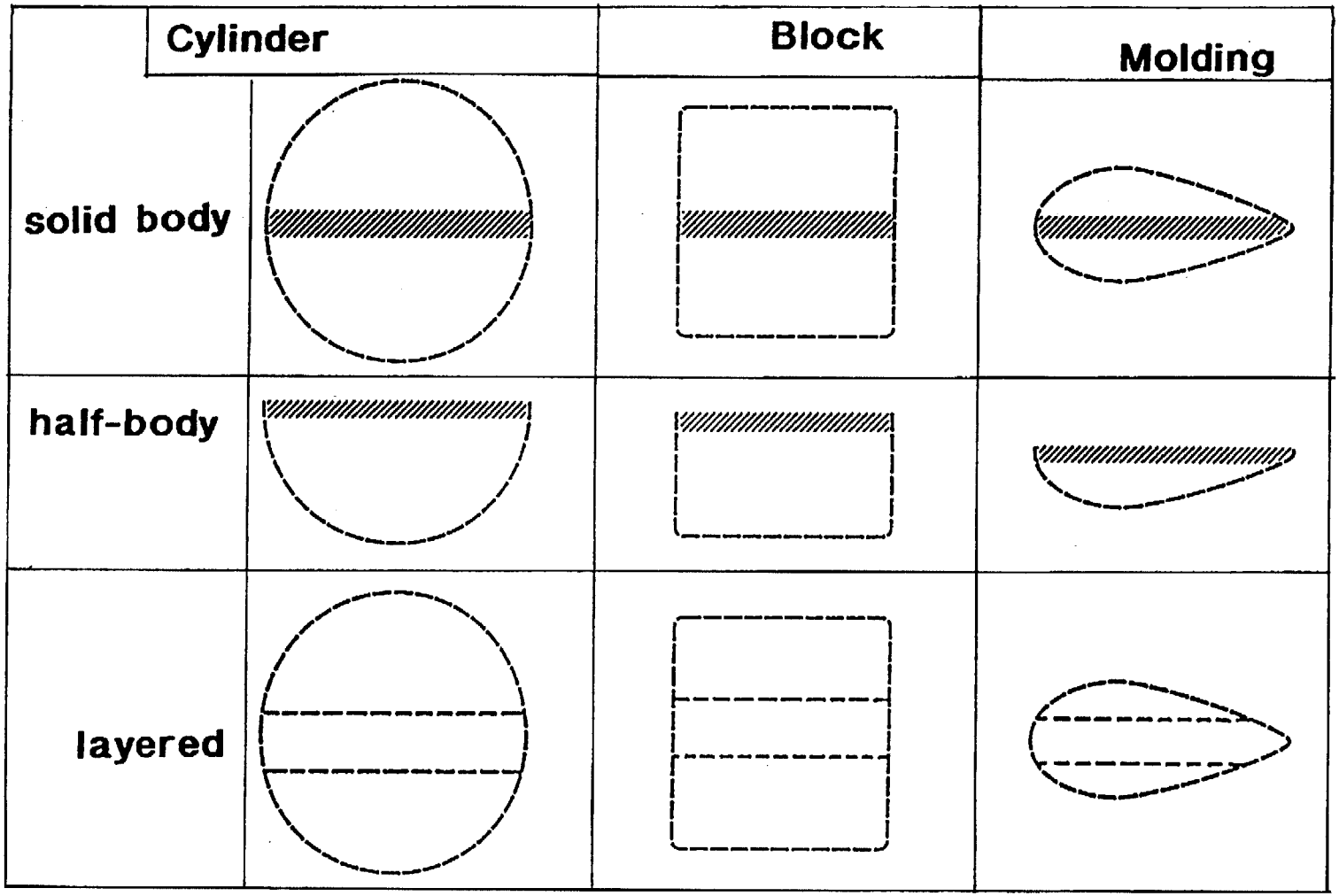
FIG. 3 shows the sound absorbers according to the present invention in the form of separate components.

Embodiments according to FIGS. 2 and 3, in which a sectional view of the invented building component is shown, are especially advantageous, because they can be placed in the room in a moveable manner thereby making the acoustics "variable". For example, depending on the number of people in a room, more or fewer absorbing glass building components can be set up to dampen sounds, ambient noise or background conversation.

Finally, completely transparent building components according to FIG. 3 can be utilized as sound absorbing and scattering elements versatilely as "compact absorbers", "central bodies" or "baffles", divorced from other building components and functions. These absorbers may function in an interior decorating manner, e.g. in conjunction with illumination.

The embodiments shown in FIG. 3 may be, e.g., suspended from the ceiling in a room. The shaded parts are massive and can themselves also be transparent, and provide structural support for the decoration, which may be in the form of a cylinder, block, or molding.

The thickness of the invented glass building component may vary between 2 to 20 mm depending on the application, preferably between 4 to 8 mm to reduce the weight.

The cross section of the hole may be round, oval, irregular or multi-cornered, the borehole running in parallel, in a cone-shape toward the inside or outside, or slanted through the panel. The panel can in addition be designed to reflect visible light or infrared light toward the outside or the inside, or it may be designed for special thermal purposes.

Figure 4A:
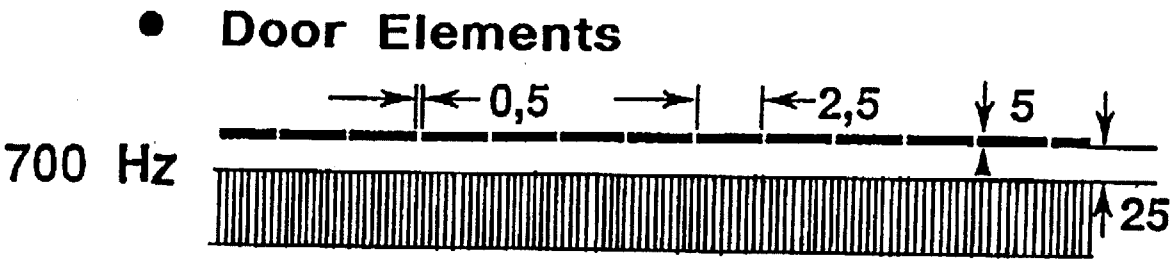
FIG. 4 shows the sound absorbers according to the present invention as front panels arranged near building components.
Figure 4B:
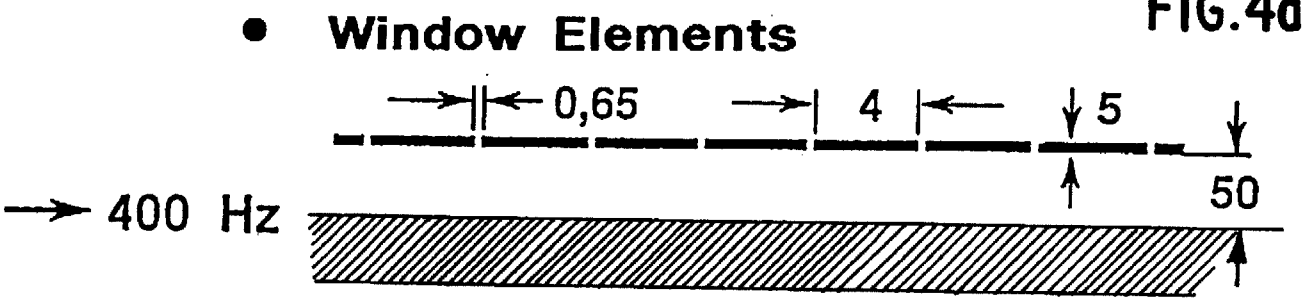
Figure 4C:
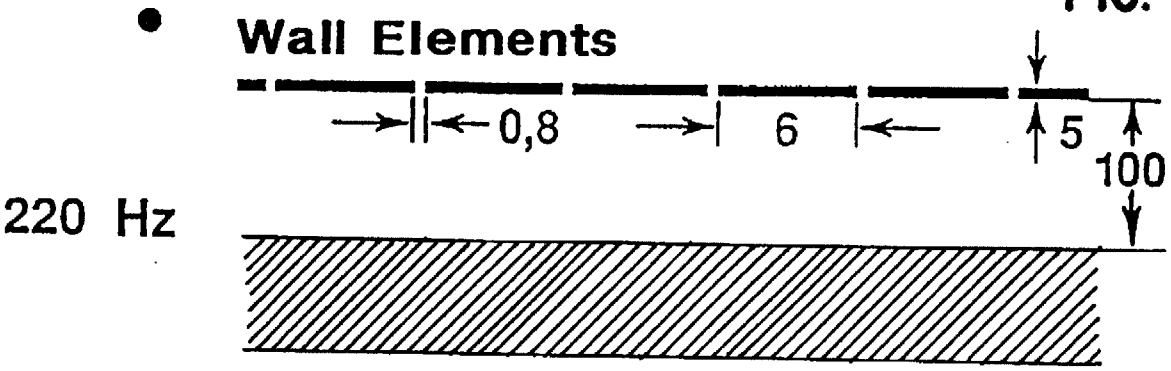
Figure 5:
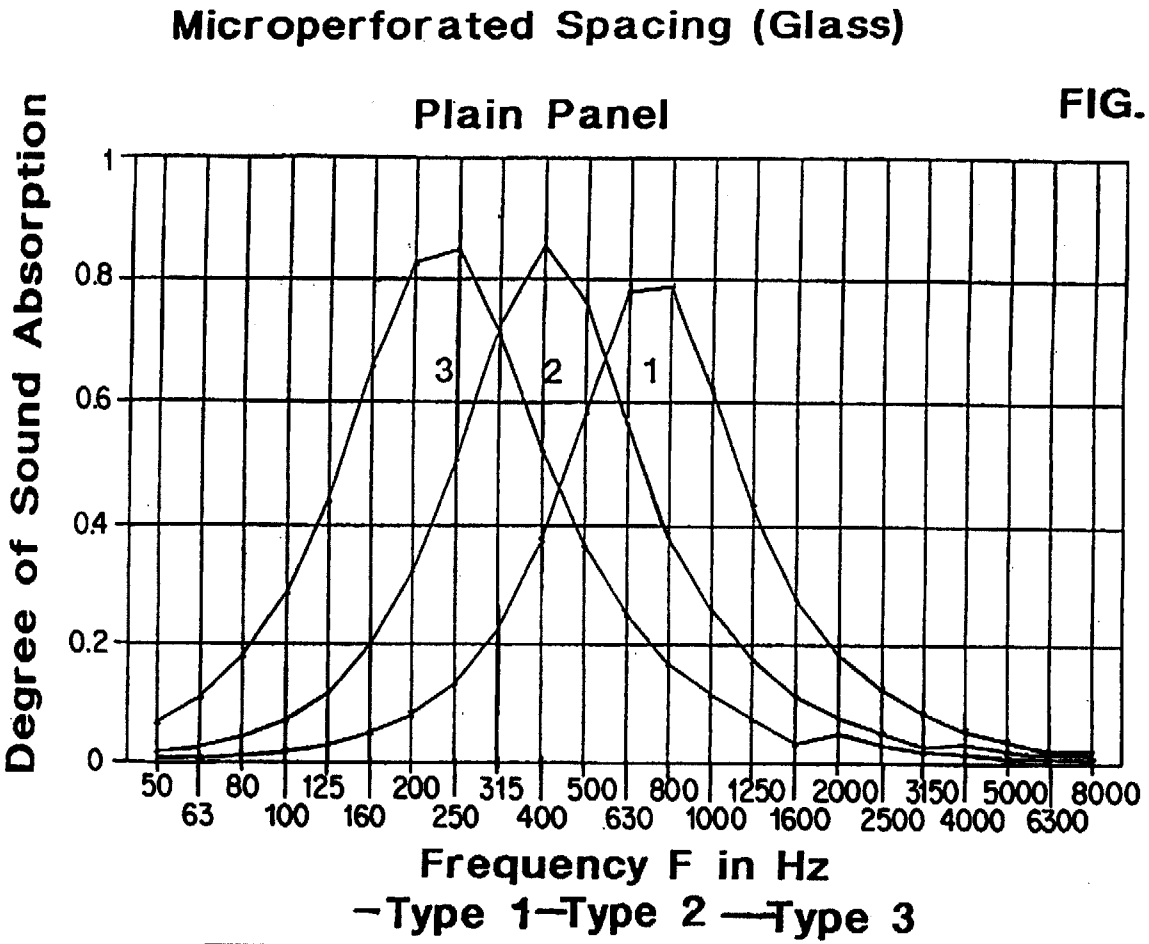
FIG. 5 shows the degree of sound absorption for various plain panel sound absorbers made of glass.
Figure 6:
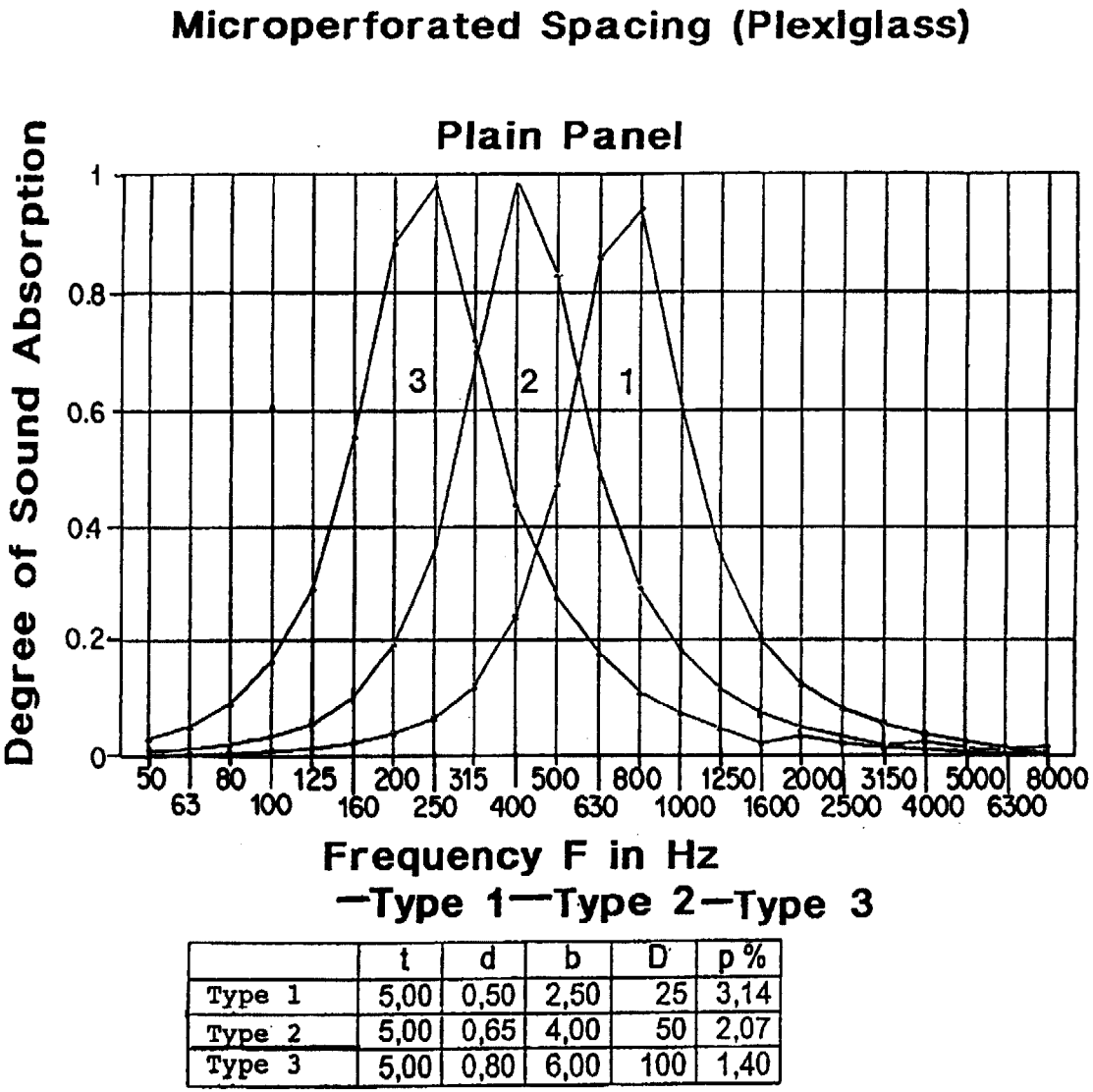
FIG. 6 shows the degree of sound absorption for various plain panel sound absorbers made of plexiglass.

FIG. 4 shows three single panel designed absorbers as plain front panels in front of different glass building components such as glass facades, glass partitions, glass ceilings, windows or doors. FIG. 5 shows the degree of sound absorption, alpha, for perpendicular sound incidence of a glass embodiment and FIG. 6 shows the results of an acrylic glass embodiment with a layer thickness of t=5 mm. If the focal point of the problem lies in another frequency range, other optimum designs can be determined by varying the geometric parameters b (distance between holes), d (hole diameter), t (panel thickness) and D distance between panel and surface.

Figure 7:
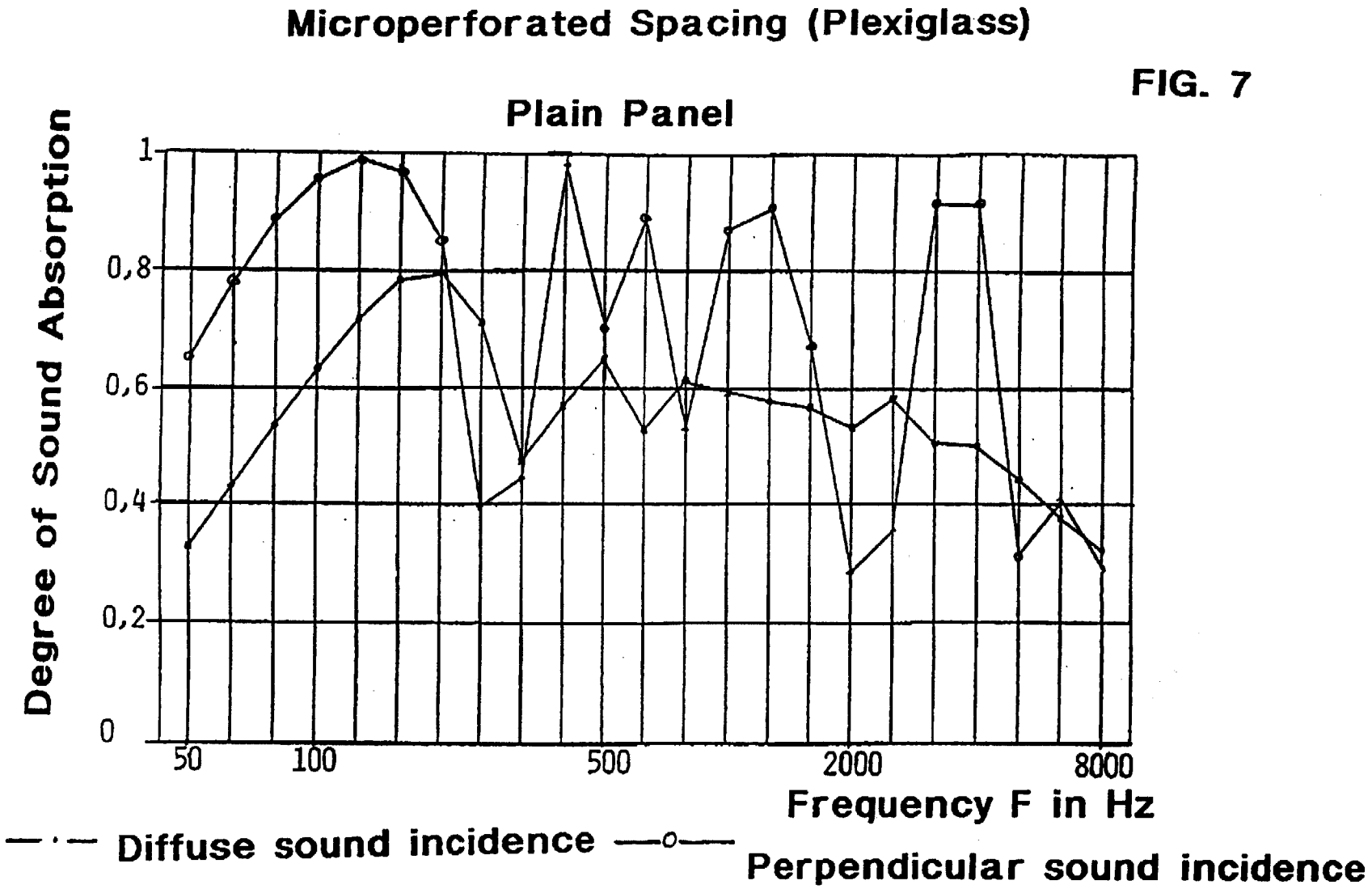
FIG. 7 shows the degree of sound absorption for a plain panel sound absorber made of plexiglass.

FIG. 7 shows another embodiment of a plain panel made of plexiglass, in which the parameters have been changed compared to the other two FIGS. 5 and 6, notably the thickness of 0.2 mm, hole diameter of 0.16 mm, holes spaced 1.4 mm apart, distance from the back wall of 600 mm and the hole-surface portion of 1.03%.

Furthermore, placing several panels with increasing distance from the wall has proven to be advantageous.

The very thin 0.2 mm thick plastic panels are thick foils provided with reinforcement in such a manner that the incident sound cannot excite the panels to vibrate. These reinforcements may be thickening or glued on strips of the same material.

What is claimed is:

1. A sound absorbing arrangement comprising a panel formed of glass or synthetic glass, said panel having first and second surfaces defining a panel thickness, said first surface being located at a distance from a building component surface and facing said building component surface such that said first surface and said building component surface define an air space therebetween, said second surface facing away from said building component surface and being exposed to an ambient atmosphere and soundwaves travelling through said ambient atmosphere, said panel defining a plurality of microperforated holes extending through said panel thickness to communicate said ambient atmosphere located opposite said building component surface with said air space.

2. A sound absorbing arrangement according to claim 1, wherein said panel thickness is within the range of 0.2–30 millimeters, said holes have a diameter within the range of 0.1–2.0 millimeters, and said holes are spaced within the range of 2–20 millimeters apart from each other.

3. A sound absorbing arrangement according to claim 2, wherein said building component surface is one of a wall, a ceiling, a window, and a door.

4. A sound absorbing arrangement according to claim 2, wherein said panel has a shape which is one of plane, bent, curved, wavy, structured, concave, convex, cylindrical, V-shaped, ellipsoid-shaped and circular.

5. A sound absorbing arrangement according to claim 1, wherein said panel forms a chamber, said building component surface being contained within said chamber.

6. A sound absorbing arrangement according to claim 2, wherein said holes have a diameter within the range of 0.1–0.8 millimeters.

7. A sound absorbing arrangement according to claim 2, wherein said holes have a diameter within the range of 0.2–0.8 millimeters.

8. A sound absorbing arrangement according to claim 2, wherein said holes extend parallel to each other.

9. A sound absorbing arrangement according to claim 2, wherein said holes have a cone-shaped configuration.

10. A sound absorbing arrangement according to claim 2, wherein said holes have a multi-cornered cross section.

11. A sound absorbing arrangement according to claim 2, wherein said holes are slanted with respect to a normal line of said panel.

12. A sound absorbing arrangement according to claim 2, wherein at least one of said surfaces of said panel is provided with at least one of an infrared reflecting coat and a visible light reflecting coat.

13. A sound absorbing arrangement according to claim 1, wherein said panel is designed to be rigid such that said soundwaves which are in the audible spectrum cannot excite said panel to vibrate.

14. A sound absorbing arrangement according to claim 2, wherein said panel is designed to be rigid such that said soundwaves which are in the audible spectrum cannot excite said panel to vibrate.

15. A sound absorbing arrangement according to claim 2, wherein said panel is supported with reinforcements such that said soundwaves which are in the audible spectrum cannot excite said panel to vibrate.

16. A sound absorbing arrangement according to claim 2, wherein a plurality of said panels are arranged in series one behind the other.

17. A sound absorbing arrangement according to claim 1, wherein said distance between the first surface and the building component surface is within the range of 20–500 millimeters.

18. A sound absorbing arrangement according to claim 1, wherein said distance between the first surface and the building component surface is within the range of 20–500 millimeters.

19. A sound absorbing arrangement according to claim 1, wherein said first surface is connected to said building component surface such that said sound absorbing arrangement comprises a single unitary building component.

20. A sound absorbing arrangement according to claim 1, wherein a periphery of said air space is enclosed by an additional surface such that said first surface, said additional surface, and said building component surface define a chamber.

* * * * *